US008233824B2

(12) United States Patent
Tomatsu

(10) Patent No.: US 8,233,824 B2
(45) Date of Patent: Jul. 31, 2012

(54) GEAR MECHANISM AND IMAGE FORMING APPARATUS

(75) Inventor: Yoshiya Tomatsu, Kasugai (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 466 days.

(21) Appl. No.: 12/507,312

(22) Filed: Jul. 22, 2009

(65) Prior Publication Data

US 2010/0021208 A1 Jan. 28, 2010

(30) Foreign Application Priority Data

Jul. 22, 2008 (JP) ..... 2008-188531

(51) Int. Cl.
*G03G 21/00* (2006.01)
*G03G 21/16* (2006.01)
*B41J 23/02* (2006.01)

(52) U.S. Cl. ..... 399/236; 399/110; 399/119; 399/126; 399/222

(58) Field of Classification Search ..... 399/110, 399/119, 122, 126, 222, 227, 236
See application file for complete search history.

(56) References Cited

U.S. PATENT DOCUMENTS

| | | | | |
|---|---|---|---|---|
| 5,585,898 | A | 12/1996 | Fujii | |
| 5,828,934 | A | 10/1998 | Tamura et al. | |
| 6,047,608 | A * | 4/2000 | Stieler | 74/409 |
| 2006/0210306 | A1 | 9/2006 | Okamoto | |
| 2006/0252595 | A1 * | 11/2006 | Koseki | 475/331 |
| 2007/0147883 | A1 | 6/2007 | Sato et al. | |
| 2007/0183814 | A1 | 8/2007 | Kamimura | |

FOREIGN PATENT DOCUMENTS

| | | |
|---|---|---|
| JP | 6-171770 | 6/1994 |
| JP | A-07-219410 | 8/1995 |
| JP | 7-248683 | 9/1995 |
| JP | A-08-143177 | 6/1996 |
| JP | 8-334980 | 12/1996 |

(Continued)

OTHER PUBLICATIONS

Official Action dated Jun. 21, 2011 received from the Japanese Patent Office from related Japanese Application No. 2008-188531, together with an English-language translation.

(Continued)

*Primary Examiner* — David Porta
*Assistant Examiner* — Jessica L Eley
(74) *Attorney, Agent, or Firm* — Scully, Scott, Murphy & Presser, PC

(57) ABSTRACT

A gear mechanism is provided and includes a first sun gear; a first planetary gear configured to mesh with the first sun gear; a first arm configured to keep a distance between the first sun gear and the first planetary gear and configured to swing around a rotation axis of the first sun gear; a second sun gear; a second planetary gear configured to mesh with the second sun gear; a second arm configured to keep a distance between the second sun gear and the second planetary gear and configured to swing around a rotation axis of the second sun gear; and an interlocking unit configured to connect the first arm and the second arm with each other for interlocking the swinging of the first arm and the second arm, the interlocking unit configured to move independently of rotations of the first sun gear and the second sun gear.

5 Claims, 6 Drawing Sheets

FOREIGN PATENT DOCUMENTS

| | | |
|---|---|---|
| JP | 9-127758 | 5/1997 |
| JP | A-11-126009 | 5/1999 |
| JP | A-2002-037482 | 2/2002 |
| JP | A-2002-296949 | 10/2002 |
| JP | A-2003-122079 | 4/2003 |
| JP | A-2005-299795 | 10/2005 |
| JP | A-2006-259148 | 9/2006 |
| JP | A-2007-086665 | 4/2007 |
| JP | 2007-178654 | 7/2007 |
| JP | A-2007-304174 | 11/2007 |

OTHER PUBLICATIONS

Japanese Official Action dated Apr. 27, 2010, together with English-language translation.

* cited by examiner

GEAR MECHANISM AND IMAGE FORMING APPARATUS

CROSS REFERENCE TO RELATED APPLICATION

The present application claims priority from Japanese Patent Application No. 2008-188531, which was filed on Jul. 22, 2008, the disclosure of which is herein incorporated by reference in its entirety.

TECHNICAL FIELD

The present invention relates to a gear mechanism and an image forming apparatus using the same.

BACKGROUND

A gear mechanism is known which includes a sun gear, a planetary gear, and an arm configured to swing around the rotary shaft of the sun gear together with the planetary gear. Further, an image forming apparatus in which the above described gear mechanism is placed is known.

In such a gear mechanism, if the swing load of the arm is too light, the arm may be moved undesirably due to gravity or oscillation, or if the swing load of the arm is too heavy, the arm may not swing as desired. In the above described cases, the operation may become unstable. If the arm does not operate as desired, the apparatus including the gear mechanism with arms may not operate as desired.

SUMMARY

Accordingly, it is an aspect of the invention to secure the reliable operation of respective arms in a gear mechanism including a plurality of sets of sun gears, planetary gears, and arms, and an image forming apparatus including the gear mechanism.

According to an illustrative aspect of the present invention, there is provided a gear mechanism comprising: a first sun gear; a first planetary gear that is configured to mesh with the first sun gear; a first arm that is configured to keep a distance between the first sun gear and the first planetary gear and configured to swing around a rotation axis of the first sun gear; a second sun gear; a second planetary gear that is configured to mesh with the second sun gear; a second arm that is configured to keep a distance between the second sun gear and the second planetary gear and configured to swing around a rotation axis of the second sun gear; and an interlocking unit that is configured to connect the first arm and the second arm with each other for interlocking a swinging of the first arm and a swinging of the second arm, the interlocking unit configured to move independently of rotations of the first sun gear and the second sun gear.

According to an another illustrative aspect of the present invention, there is provided an image forming apparatus comprising: the gear mechanism according to the above described illustrative aspect of the present invention; an electrostatic latent image carrying member, on the surface of which an electrostatic latent image is formed; a developing unit configured to supply a developer to the electrostatic latent image formed on the surface of the electrostatic latent image carrying member; a transfer unit configured to transfer, to a recording medium, the developer supplied on the surface of the electrostatic latent image carrying member by the developing unit; and a fixing unit configured to thermally fix the developer transferred to the recording medium by the transfer unit, wherein the first planetary gear transmits a driving force to the developing unit, the second planetary gear transmits a driving force to the fixing unit, and the interlocking unit swings the second arm at a position where the second planetary gear transmits the driving force to the fixing unit when the first arm swings at a position where the first planetary gear transmits the driving force to the developing unit, and swings the second arm at a position where the second planetary gear does not transmit the driving force to the fixing unit when the first arm swings at a position where the first planetary gear does not transmit the driving force to the developing unit.

BRIEF DESCRIPTION OF THE DRAWINGS

Illustrative aspects of the invention will be described in detail with reference to the following figures wherein.

DETAILED DESCRIPTION OF EXEMPLARY EMBODIMENTS OF THE PRESENT INVENTION

[Overall Configuration of Image Forming Apparatus]

Figure 1:
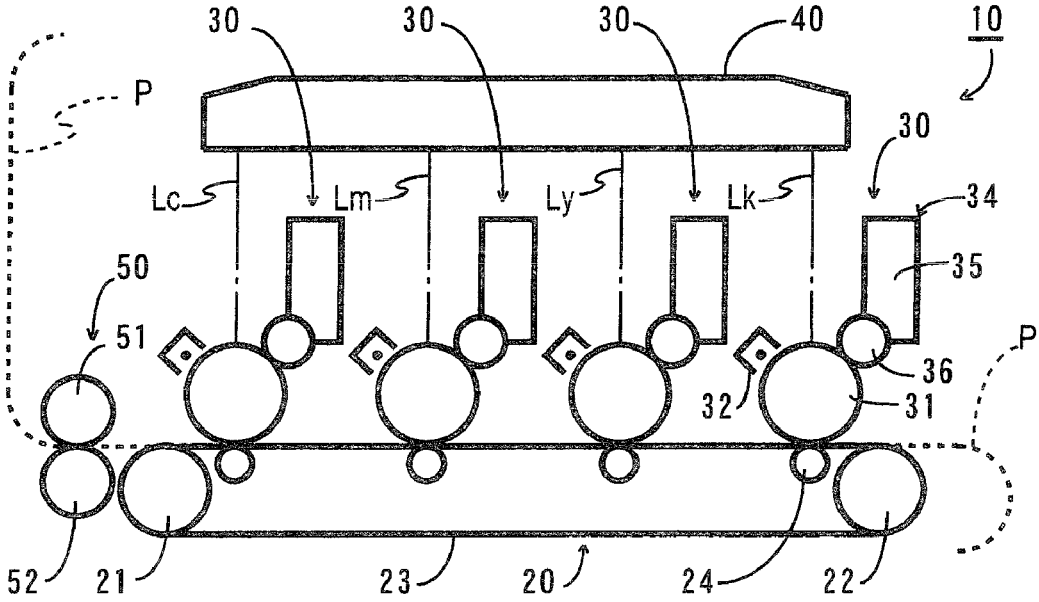
FIG. 1 is a schematic view showing an image forming apparatus according to an exemplary embodiment of the present invention.

An exemplary embodiment of the invention will now be described with reference to the drawings. FIG. 1 is a schematic view showing the configuration of an image forming apparatus 10 to which the invention is applied. As shown in FIG. 1, the image forming apparatus 10 includes four image forming units 30 corresponding to respective colors of black (K), yellow (Y), magenta (M), and cyan (C) above a belt unit 20, in which a transport belt 23 is stretched between a driving roller 21 and a driven roller 22. The four image forming units 30 are arranged in parallel in an order of black, yellow, magenta, and cyan from the upstream side (hereinafter, referred to a front side) of a transport direction of a sheet P (an example of a recording medium), thereby forming a direct tandem type color image forming unit.

Each of the image forming units 30 includes a photosensitive drum 31 that is an example of an electrostatic latent image carrying member, a scorotron type charger 32, and a developing cartridge 34. The photosensitive drum 31 includes a grounded metallic drum body, the surface of which is covered with a positively chargeable photosensitive layer made of polycarbonate.

The charger 32 is disposed opposite the photosensitive drum 31 at an interval so as not to come into contact with the photosensitive drum 31 obliquely above the rear side of the photosensitive drum 31. The charger 32 has a charging wire made of tungsten or the like for producing corona discharge, and functions to uniformly positively charge the surface of the photosensitive drum 31. The developing cartridge 34 is a developing cartridge that is provided with a toner accommodating chamber 35 therein, and functions to positively frictionally charge positively chargeable, non-magnetic one component toner of black, cyan, magenta, or yellow as an example of a developer accommodated in the toner accommodating chamber 35 and to supply toner to the photosensitive drum 31 through a developing roller 36 as an example of a developing unit.

The belt unit 20 includes four transfer rollers 24 as an example of a transfer unit at positions opposite the respective photosensitive drums 31 with a transport belt 23 interposed therebetween. The rotation of the driving roller 21 in a counterclockwise direction of FIG. 1 causes the transport belt 23 to be driven to rotate in the same direction. A sheet P is fed onto the surface of the transport belt 23 from a sheet feed tray, which is inserted below the belt unit 20, by various rollers, such as a sheet feed roller and the like. The sheet P is transported in a left direction (backward) on FIG. 1 through a portion opposite the photosensitive drum 31.

A scanner unit 40 is provided above the image forming units 30. The scanner unit 40 is a scanner unit that includes a semiconductor laser and a polygon mirror, and functions to scan and expose the respective photosensitive drums 31. The semiconductor laser generates laser light Lk, Ly, Lm, and Lc corresponding to image data of the respective colors. The polygon mirror deflects laser light L. According to the above configuration, the surface of each of the photosensitive drums 31 is first uniformly positively charged by the charger 32 during rotation. Thereafter, the surface of the photosensitive drum 31 is exposed by high-speed scan of laser light L from the scanner unit 40, and thus an electrostatic latent image corresponding to an image to be formed on the sheet P is formed on the surface of the photosensitive drum 31. Next, positively charged toner that is carried on the developing roller 36 is supplied to the electrostatic latent image formed on the surface of the photosensitive drum 31 by the rotation of the developing roller 36 opposite to the photosensitive drum 31 when the developing roller 36 is opposite and comes into contact with the photosensitive drum 31. In this way, the electrostatic latent image of the photosensitive drum 31 is visualized, and toner is attached to the exposed portion on the surface of the photosensitive drum 31. Thus, a toner image is carried on the surface of the photosensitive drum 31.

Thereafter, the toner images carried on the surfaces of the photosensitive drums 31 are sequentially transferred to the sheet P by a negative transfer bias that is applied to the transfer rollers 24 by constant current control when the sheet P to be transported by the transport belt 23 passes between the photosensitive drums 31 and the transfer rollers 24. Next, the sheet P to which the toner images are transferred in such a manner is transported to a fixer 50 that is provided on the downstream side in the sheet transport direction of the belt unit 20.

The fixer 50 includes a heating roller 51 and a pressing roller 52. The heating roller 51 that is an example of a fixing unit includes a heat source, such as a halogen lamp or the like, and is driven to rotate. The pressing roller 52 is disposed below the heating roller 51 opposite the heating roller so as to press the heating roller 51 and is rotated by the rotation of the heating roller 51. The fixer 50 heats the sheet P, on which the toner images of the four colors are carried, while the sheet P is pinched and transported by the heating roller 51 and the pressing roller 52, thereby thermally fixing the toner images onto the sheet P. The sheet P onto which the toner images are thermally fixed is discharged to a sheet discharge tray, which is provided at the upper surface of the image forming apparatus 10, by various rollers.

[Configuration of Developing and Fixing Driving Unit]

Figure 2:
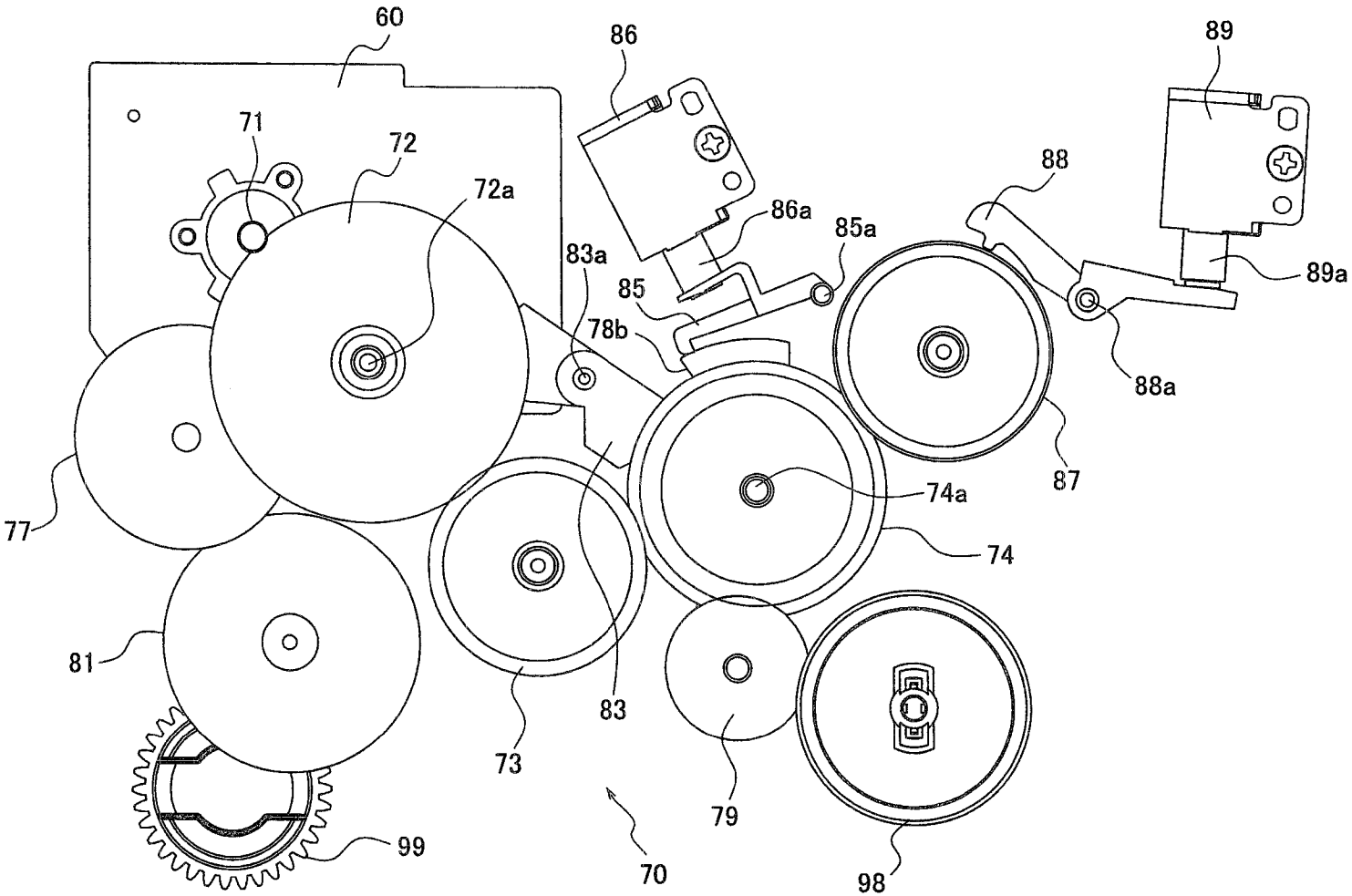
FIG. 2 is a front view showing a gear mechanism of the image forming apparatus according to the exemplary embodiment.

Next, the configuration of a driving unit driving the developing roller 36 or the heating roller 51 will be described. As shown in FIG. 2, the image forming apparatus 10 includes a motor 60. The driving force of the motor 60 is transmitted to a developing roller gear 98 driving the developing roller 36 and a heating roller gear 99 driving the heating roller 51 through a gear mechanism 70 described below. FIG. 2 is a front view showing the configuration of the gear mechanism 70 when viewed from the same side as FIG. 1.

As shown in FIG. 2, a pinion gear 71 that is fixed to the rotary shaft of the motor 60 is meshed with a sun gear 72, and the sun gear 72 is meshed with a sun gear 74 through an idle gear 73.

Figure 3:
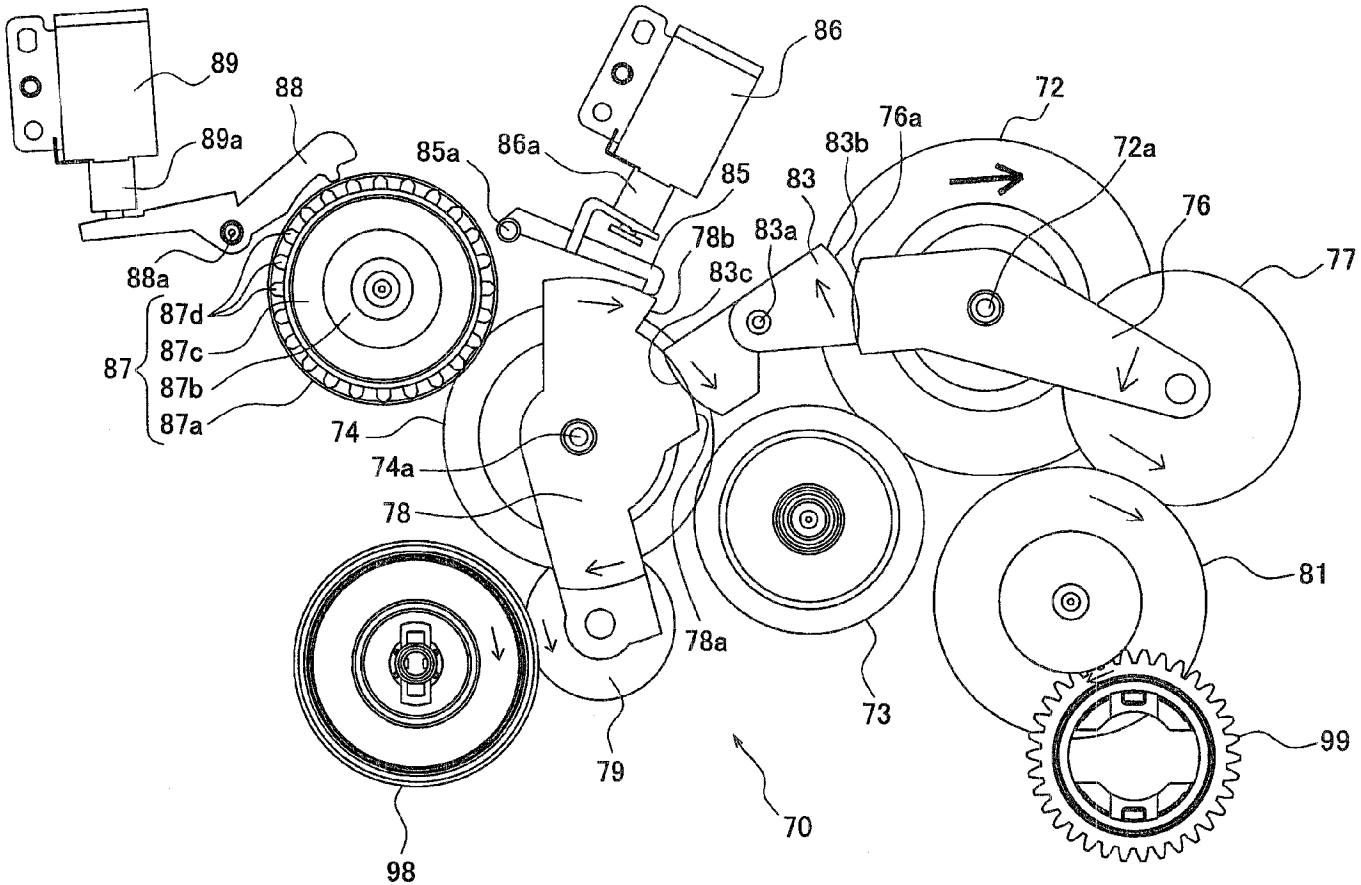
FIG. 3 is a rear view showing the gear mechanism according to the exemplary embodiment.

FIG. 3 is a rear view showing the configuration of the gear mechanism 70 when viewed from the rear side of FIGS. 1 and 2. As shown in FIG. 3, an arm 76 is provided at a rotary shaft 72*a* of the sun gear 72 so as to freely swing around the rotary shaft 72*a*. A planetary gear 77 is rotatably provided at the leading end of the arm 76 so as to swing together with the arm 76 while being kept meshed with the sun gear 72. Similarly, an arm 78 is provided at a rotary shaft 74*a* of the sun gear 74 so as to freely swing around the rotary shaft 74*a*. A planetary gear 79 is rotatably provided at the leading end of the arm 78 so as to swing together with the arm 78 while being kept meshed with the sun gear 74.

The arm 76 is configured to swing, in the same direction as a rotation direction of the sun gear 72, due to a frictional force between the sun gear 72 and the planetary gear 77 and a frictional force between the sun gear 72 and the arm 76. Further, the arm 78 is configured to swing, in the same direction as a rotation direction of the sun gear 74, due to a frictional force between the sun gear 74 and the planetary gear 79 and a frictional force between the sun gear 74 and the arm 78. The sun gear 74 is meshed with the sun gear 72 through the idle gear 73, accordingly, the sun gear 74 rotates in the same direction as a rotation direction of the sun gear 72. Therefore, the arm 76 and the arm 78 rotate in the same direction each other in a response to the rotation direction of the sun gear 72.

According to the above described configuration, if the motor 60 rotates in a clockwise direction of FIG. 2 (hereinafter, referred to as CW driving), as indicated by an arrow in FIG. 3, the sun gear 72 rotates in a clockwise direction of FIG. 3, the arm 76 swings in the clockwise direction, and the planetary gear 77 also swings in the same manner. In this case, a deceleration gear 81 that is meshed with the heating roller gear 99 is provided at a position where the planetary gear 77 is to be meshed. In this way, the planetary gear 77 and the deceleration gear 81 are meshed with each other, and thus the heating roller 51 can be driven to rotate in the sheet transport direction.

If the sun gear 72 rotates in the clockwise direction of FIG. 3, the sun gear 74 also rotates in the same manner, the arm 78 also swings in the clockwise direction, and the planetary gear 79 also swings in the same manner. In this case, the developing roller gear 98 is provided at a position where the planetary gear 79 is to be meshed. In this way, the planetary gear 79 and the developing roller gear 98 are meshed with each other, and thus the developing roller 36 can be driven to rotate in a direction opposite to the photosensitive drum 31. According to the above described configuration, at the time of the CW driving of the motor 60, the heating roller 51 and the developing roller 36 can be driven simultaneously by the single motor 60.

Meanwhile, if the motor 60 rotates in a counterclockwise direction of FIG. 2 (hereinafter, referred to as CCW driving), as indicated by an arrow in FIG. 4, the sun gears 72 and 74 rotate in a counterclockwise direction of FIG. 4, and the arms 76 and 78 swing in the counterclockwise direction together with the planetary gears 77 and 79, respectively. A stopper is provided near the arms 76 and 78. The swings of the arm 76 in the counterclockwise direction are stopped when the planetary gear 77 and the deceleration gear 81 are unmeshed with each other. The swings of the arm 78 in the counterclockwise direction are stopped when the planetary gear 79 and the developing roller gear 98 are unmeshed with each other. According to the above described configuration, at the time of the CCW driving of the motor 60, no driving force is transmitted to the developing roller 36 and the heating roller 51, and there is no case where the developing roller 36 and the heating roller 51 rotate in reverse.

As described above, since the sun gears 72 and 74 are interlocked with each other through the idle gear 73, the swings of the arms 76 and 78 are interlocked with each other. In this embodiment, a link 83 as an example of an interlocking unit is provided so as to reliably interlock the arms 76 and 78 with each other. As shown in FIGS. 3 and 4, the opposite surfaces of the arms 76 and 78 have an arc shape, and have geared teeth 76*a* and 78*a* at the arc-shaped portions, respectively. The link 83 has a bow tie-like flat plate shape so as to swing around a shaft 83*a*. The link 83 has both ends having an arc shape, and has teeth 83*b* and 83*c*, which are meshed with the teeth 76*a* and 78*a*, respectively, at both ends. According to the above described configuration, the arm 76, the link 83, the arm 78 are interlocked with each other and swing by the meshed state of the teeth 76*a* of the arm 76 and the teeth 83*b* of the link 83 and the meshed state of the teeth 78*a* of the arm 78 and the teeth 83*c* of the link 83.

An engagement portion 78*b* that protrudes in a substantially rectangular shape is provided at an edge of the arm 78 on a side opposite to a side on which the planetary gear 79 is provided. A hook 85 is provided at a position opposite the engagement portion 78*b* so as to swing around a shaft 85*a*. The hook 85 swings due to protrusion/retraction of a plunger 86*a* of a solenoid 86. The plunger 86*a* is pressed in the protrusion direction when the solenoid 86 is turned off (non-conduction state). In a state when the planetary gears 77 and 79, the deceleration gear 81, and the developing roller gear 98 are meshed with each other, as shown in FIG. 3, the leading end of the hook 85 comes into contact with the outer circumference of the engagement portion 78*b* and is not engaged with the engagement portion 78*b*. As shown in FIG. 4, when the planetary gears 77 and 79, the deceleration gear 81, and the developing roller gear 98 are unmeshed with each other, the leading end of the hook 85 is engaged with the engagement portion 78*b*.

Figure 4:
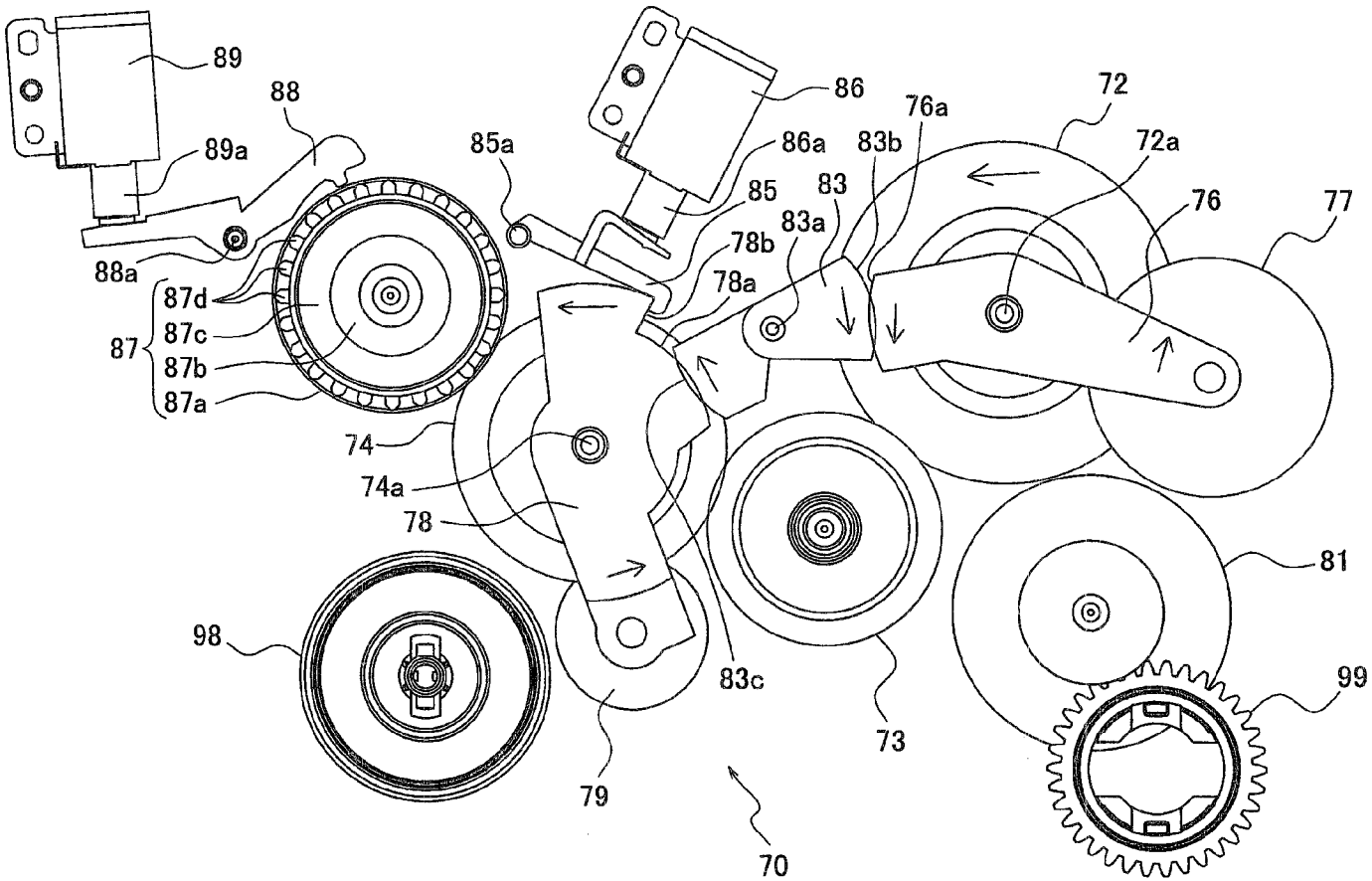
FIG. 4 is a rear view showing the gear mechanism in another operation state.

Therefore, when the motor 60 is CW driven from the state of FIG. 4 in order to drive the developing roller 36 and the heating roller 51 again, as shown in FIG. 3, it is necessary to turn on (conduction) the solenoid 86 so as to release the engagement of the engagement portion 78*b* and the hook 85. The hook 85 and the solenoid 86 correspond to a locking unit that fixes the swing position of the arm 78 against a force, which is applied to the arm 78 due the meshed state of the sun gears 72 and 74 and the planetary gears 77 and 79, and the self weights of the arms 76 and 78 and the planetary gears 77 and 79. After the solenoid 86 is turned on (conduction) so as to release the engagement of the engagement portion 78*b* and the hook 85, in a state where the developing roller 36 and the heating roller 51 are driven to rotate by the CW driving of the motor 60, as shown in FIG. 3, the leading end of the hook 85 comes into contact with the outer circumference of the engagement portion 78*b*. In this case, even if the solenoid 86 is not continuously turned on (conduction), there is no case where the hook 85 moves to a lock position.

The sun gear 74 is also meshed with the outer circumference of a ring gear 87*a* of a clutch gear 87. The ring gear 87*a* of the clutch gear 87 has inner teeth at its inner circumferential surface. A plurality of planetary gears are provided between a sun gear, which rotates together with a sun gear 87*b*, and the inner teeth. Teeth 87*d* are formed at the outer circumference of a carrier 87*c*, which supports the planetary gears. A hook 88 is provided at a position opposite the teeth 87*d* so as to swing around a shaft 88*a*. The hook 88 swings due to protrusion/retraction of a plunger 89*a* of a solenoid 89. The plunger 89*a* is pressed in the protrusion direction when the solenoid 89 is turned off (non-conduction state). In this case, the hook 88 is separated from the teeth 87*d* of the carrier 87*c*. In this state, even if the driving force of the sun gear 74 is transmitted and the ring gear 87*a* rotates, the carrier 87*c* freely rotates, and thus the sun gear 87*b* does not rotate.

If the solenoid 89 is turned on so as to engage the leading end of the hook 88 with the teeth 87*d* of the carrier 87*c* and to inhibit the rotation of the carrier 87*c*, the sun gear 87*b* rotates in a direction opposite to the ring gear 87*a* by the driving force transmitted to the ring gear 87*a*. A rack of a translation cam that brings the developing rollers 36 into contact with photosensitive drums 31 or separates the developing rollers 36 from the photosensitive drums 31 is engaged with the outer circumference of the sun gear 87*b* from below. According to the above described configuration, if the sun gear 87*b* is rotated in the clockwise direction of FIG. 4 so as to move the translation cam forward, the developing rollers 36 can be individually brought into contact with the photosensitive drums 31. If the sun gear 87*b* is rotated in the counterclockwise direction of FIG. 4 so as to move the translation cam backward, the developing rollers 36 can be individually separated from the photosensitive drums 31.

Figure 5:
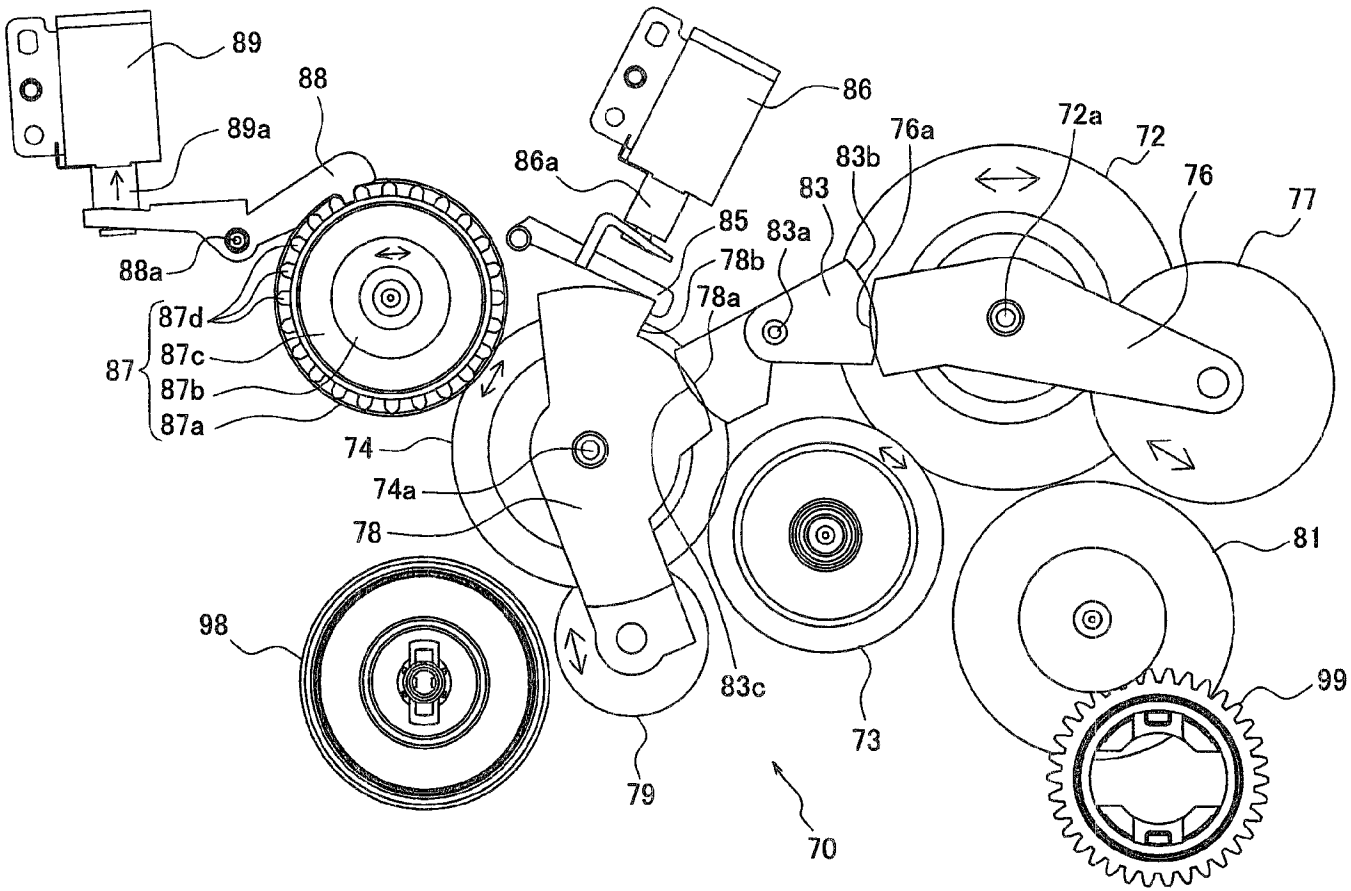
FIG. 5 is a rear view showing the gear mechanism in yet another operation state.
Figure 6:
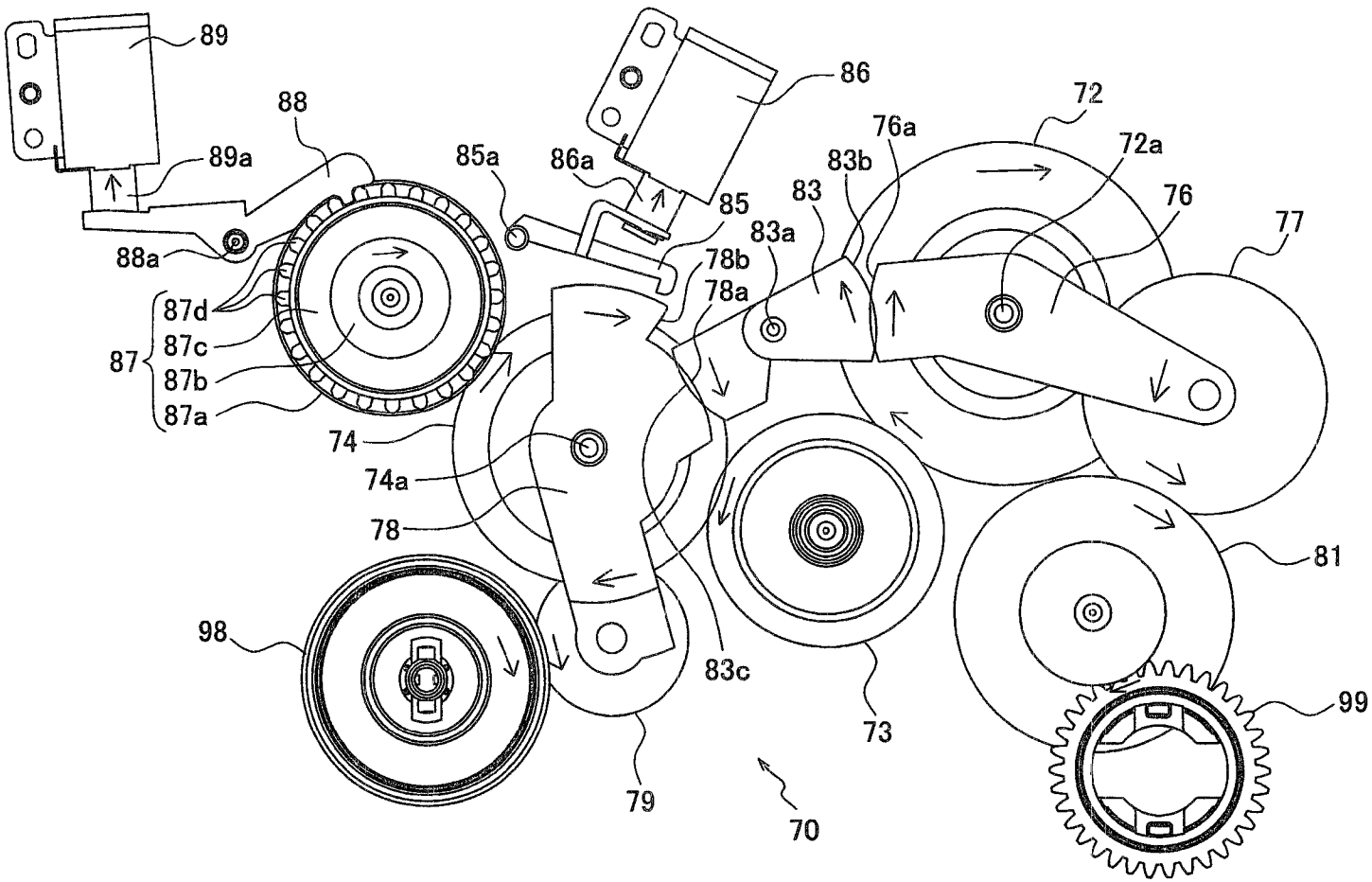
FIG. 6 is a rear view showing the gear mechanism in yet another operation state.

As described above, in a state where the leading end of the hook 85 is engaged with the engagement portion 78*b*, no matter what direction the motor 60 is driven in, the planetary gears 77 and 79 are not meshed with the deceleration gear 81 and the developing roller gear 98. Therefore, in this state, if the solenoid 89 is turned on so as to engage the hook 88 with the teeth 87*d* of the carrier 87*c*, as shown in FIG. 5, the motor 60 can be driven in an arbitrary direction so as to move the translation cam in an arbitrary direction, without driving the developing roller 36 and the heating roller 51. From this state, if the solenoid 86 is turned on so as to release the engagement of the engagement portion 78*b* and the hook 85, as shown in FIG. 6, the planetary gears 77 and 79 and the deceleration gear 81 and the developing roller gear 98 are meshed with each other. Therefore, the translation cam can be moved forward while driving the developing roller 36 and the heating roller 51.

Advantages of the Exemplary Embodiment and Modifications

As described above, in the gear mechanism 70 of this embodiment, the arms 76 are 78 are directly and reliably interlocked with each other through the link 83. Therefore, the above-described operations of the planetary gears 77 and 79 can be reliably carried out. In addition, the arm 76, the link 83, and the arm 78 are interlocked with each other and swing by the meshed state of the geared teeth 76*a* and 78*a* in the arms 76 and 78 and the meshed state of the geared teeth 83*b* and 83*c* at both ends of the link 83. Therefore, the above-described operations can be more reliably carried out.

In the image forming apparatus 10 of this embodiment, with the operation of the planetary gears 77 and 79, an operation to drive the developing roller 36 and the heating roller 51 simultaneously so as to form an image, and an operation to cause the developing roller 36 and the heating roller 51 to be not driven can be selectively carried out. In addition, in a state where the leading end of the hook 85 is engaged with the engagement portion 78*b* of the arm 78, the developing roller 31 and the heating roller 51 are not driven, and thus the sun gear 87*b* can be driven forward and backward so as to drive the translation cam in the front and back directions. As described above, since the arms 76 and 78 are interlocked with each other through the link 83, the swing positions of the two arms 76 and 78 can be fixed by one set of the solenoids 86 and the hook 85. Therefore, while the image forming apparatus 10 of this embodiment can execute the complex operation described above, it is not necessary to provide a plurality of solenoids for the above-described operation, and as a result, manufacturing costs can be favorably reduced.

The invention is not limited to the above described exemplary embodiment, and various modifications may be made without departing from the spirit and scope of the invention. For example, in a state where the leading end of the hook 85 is engaged with the engagement portion 78*b* of the arm 78, members other than the translation cam may be moved in an arbitrary direction. In the above described exemplary embodiment, the sun gears 72 and 74 are meshed with each other through the single idle gear 73. Alternatively, more gears may be provided between the sun gears 72 and 74, or the sun gears 72 and 74 may be directly meshed with each other. Three or more arms may be provided.

The interlocking unit interlocking at least a pair of arms may be implemented in various ways. For example, at least a pair of arms may be interlocked with each other by a rod-shaped link or a belt, or the teeth of a pair of arms may be directly meshed with each other. In the latter case, the teeth in the arms correspond to an interlocking unit. The image forming apparatus of the invention may also be applied to a monochrome image forming apparatus, and the gear mechanism of the invention may also be applied to various apparatuses other than the image forming apparatus.

As described above, according to an illustrative aspect of the present invention, there is provided a gear mechanism comprising: at least a pair of sun gears configured to be meshed with each other directly or through another gear; at least a pair of planetary gears configured to be meshed with the sun gears, respectively; at least a pair of arms provided for respective sets of the sun gears and the planetary gears so as to swing around the rotary shafts of the respective sun gears together with the respective planetary gears while keeping the meshed state of the sun gears and the planetary gears; and an interlocking unit configured to interlock the swings of the arms with each other not through the gears.

In the gear mechanism of the invention configured as above, at least a pair of sun gears that are meshed with each other directly or through another gear are kept meshed with the planetary gears by the arms, each of which swings around the rotary shaft of a corresponding one of the sun gears. Since the sun gears are meshed with each other directly or through another gear, while the swings of the respective arms are interlocked with each other, the swings of the arms are interlocked with each other through the interlocking unit, not through the gears. Therefore, in this aspect of the invention, the plurality of arms is directly interlocked with each other through the interlocking unit, thereby securing the reliable operation of the respective arms.

Although it is not intended to limit the invention, a locking unit may be provided in at least one of the arms so as to fix the swing position of the arm against a force to be applied to the arm by the meshed state of the sun gears and the planetary gears and a force to be applied to the arm by the self weights of the arms and the planetary gear. In this case, the swing position of the one arm can be fixed by the locking unit. As described above, since the one arm and the other arm are interlocked with each other by the operation of the interlocking unit, the swing positions of a plurality of arms can be fixed by a single locking unit. Therefore, manufacturing costs for the apparatus can be reduced, as compared with a case where a locking unit is provided for each of a plurality of arms.

Each of the arms may have geared teeth, and the interlocking unit may have teeth that are meshed with the teeth of the respective arms and may interlock the swings with each other by the meshed state of the teeth. In this case, the arms are interlocked with each other by using the meshed state of the teeth, and thus the arms can be more reliably interlocked with each other.

According to an another illustrative aspect of the present invention, there is provided an image forming apparatus comprising the gear mechanism according to the above illustrative aspect of the invention; an electrostatic latent image carrying member, on the surface of which an electrostatic latent image is formed; a developing unit configured to supply a developer to the electrostatic latent image formed on the surface of the electrostatic latent image carrying member; a transfer unit configured to transfer, to a recording medium, the developer supplied on the surface of the electrostatic latent image carrying member by the developing unit; and a fixing unit configured to thermally fix the developer transferred to the recording medium by the transfer unit, one of the planetary gears transmits a driving force to the developing unit, the other of the planetary gears transmit a driving force to the fixing unit, and the interlocking unit swings the arm for the other planetary gear at a position where the other planetary gear transmits the driving force to the fixing unit when the arm for the one planetary gear swings at a position where the one planetary gear transmits the driving force to the developing unit, and swings the arm for the other planetary gear at a position where the other planetary gear does not transmit the driving force to the fixing unit when the arm for the one planetary gear swings at a position where the one planetary gear does not transmit the driving force to the developing unit.

In the image forming apparatus of the invention configured as above, the developer is supplied on the electrostatic latent image formed on the surface of the electrostatic latent image bearing member by the developing unit, and the attached developer is transferred to the recording medium by the transfer unit. In this way, an image by the developer can be formed on the recording medium. The developer transferred to the recording medium by the transfer unit is thermally fixed by the fixing unit. Therefore, the image can be fixed to the recording medium.

In the image forming apparatus of the invention, when the arm for one planetary gear swings at the position where the one planetary gear transmits the driving force to the developing unit, the arm for the other planetary gear can swing at the position where the other planetary gear transmits the driving force to the fixing unit, and when the arm for the one planetary gear swings at the position where the one planetary gear does not transmit the driving force to the developing unit, the arm for the other planetary gear can swing at the position where the other planetary gear does not transmit the driving force to the fixing unit. Therefore, an operation to simultaneously drive the developing unit and the fixing unit so as to form an image, and an operation to drive other members while causing the developing unit and the fixing unit to be not driven can be selectively carried out.

In the image forming apparatus of the invention, the gear mechanism is a gear mechanism including the locking unit, and the locking unit may fix the swing position of one of the arms so as to hold the arm for the one planetary gear at a position where the one planetary gear does not transmit the driving force to the developing unit, and to hold the arm for the other planetary gear at a position where the other planetary gear does not transmit the driving force to the fixing unit. In this case, the developing unit and the fixing unit can be set to be not driven by a single locking unit. In addition, while the developing unit and the fixing unit are set to be not driven, other members can be driven forward and backward.

While the present invention has been shown and described with reference to certain exemplary embodiments thereof, it will be understood by those skilled in the art that various changes in form and detail may be made therein without departing the sprit and the scope of the invention as defined by the appended claims.

What is claimed is:

1. A gear mechanism comprising:

a first sun gear;

a first planetary gear that is configured to mesh with the first sun gear;

a first arm that is configured to keep a distance between the first sun gear and the first planetary gear and configured to swing around a rotation axis of the first sun gear;

a second sun gear;

a second planetary gear that is configured to mesh with the second sun gear;

a second arm that is configured to keep a distance between the second sun gear and the second planetary gear and configured to swing around a rotation axis of the second sun gear; and an interlocking unit that is configured to connect the first arm and the second arm with each other for interlocking a swinging of the first arm and a swinging of the second arm, the interlocking unit configured to move independently of rotations of the first sun gear and the second sun gear.

2. The gear mechanism according to claim 1, further comprising:

a locking unit that is provided for at least one of the first arm and the second arm, the locking unit configured to lock a swing position of the first arm or the second arm.

3. The gear mechanism according to claim 1, wherein the first arm comprises first gear teeth;

the second arm comprises second gear teeth; and the interlocking unit comprises third gear teeth that are configured to be meshed with the first gear teeth and the second gear teeth.

4. An image forming apparatus comprising:

the gear mechanism according to claim 1;

an electrostatic latent image carrying member, on the surface of which an electrostatic late nt image is formed;

a developing unit configured to supply a developer to the electrostatic latent image formed on the surface of the electrostatic latent image carrying member;

a transfer unit configured to transfer, to a recording medium, the developer supplied on the surface of the electrostatic latent image carrying member by the developing unit; and a fixing unit configured to thermally fix the developer transferred to the recording medium by the transfer unit, wherein the first planetary gear transmits a driving force to the developing unit, the second planetary gear transmits a driving force to the fixing unit, and the interlocking unit swings the second arm at a position where the second planetary gear transmits the driving force to the fixing unit when the first arm swings at a position where the first planetary gear transmits the driving force to the developing unit, and swings the second arm at a position where the second planetary gear does not transmit the driving force to the fixing unit when the first arm swings at a position where the first planetary gear does not transmit the driving force to the developing unit.

5. The image forming apparatus according to claim 4, wherein the gear mechanism further comprises: a locking unit that is provided for at least one of the first gear and the second arm, the locking unit configured to lock a swing position of the first arm or the second arm, and, wherein the locking unit fixes the swing position of the first arm so as to hold the first arm at a position where the first planetary gear does not transmit the driving force to the developing unit, and to hold the second arm at a position where the second planetary gear does not transmit the driving force to the fixing unit.

* * * * *